US010627738B2

(12) United States Patent
Ogawa et al.

(10) Patent No.: US 10,627,738 B2
(45) Date of Patent: Apr. 21, 2020

(54) DEVELOPER REGULATING MEMBER, DEVELOPING DEVICE, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Yoshinobu Ogawa, Numazu (JP); Mitsuru Okuda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/452,874

(22) Filed: Jun. 26, 2019

(65) Prior Publication Data

US 2020/0026216 A1 Jan. 23, 2020

(30) Foreign Application Priority Data

Jul. 19, 2018 (JP) ..... 2018-135904

(51) Int. Cl.
*G03G 15/08* (2006.01)
*G03G 15/16* (2006.01)
*G03G 21/00* (2006.01)

(52) U.S. Cl.
CPC ..... *G03G 15/0812* (2013.01); *G03G 15/0818* (2013.01); *G03G 15/16* (2013.01); *G03G 21/0058* (2013.01)

(58) Field of Classification Search
CPC ..... G03G 15/081; G03G 15/0812
See application file for complete search history.

(56) References Cited

U.S. PATENT DOCUMENTS

| | | | |
|---|---|---|---|
| 9,952,532 | B2 | 4/2018 | Sugiyama et al. |
| 10,073,374 | B2 | 9/2018 | Ogawa et al. |
| 10,078,291 | B2 | 9/2018 | Shinkawa et al. |
| 2003/0157369 | A1 | 8/2003 | Yoshikawa et al. |
| 2004/0175640 | A1 | 9/2004 | Kawanishi et al. |
| 2006/0131546 | A1 | 6/2006 | Yoshikawa et al. |
| 2017/0357209 | A1 | 12/2017 | Mochizuki et al. |
| 2018/0032000 | A1 | 2/2018 | Shinkawa et al. |

FOREIGN PATENT DOCUMENTS

| | | | |
|---|---|---|---|
| JP | 2000-39765 | A | 2/2000 |
| JP | 2001-175076 | A | 6/2001 |
| JP | 2003-223027 | A | 8/2003 |
| JP | 2004-138629 | A | 5/2004 |

OTHER PUBLICATIONS

Extended European Search Report in European Application No. 19184062.8 (dated Jan. 2020).

*Primary Examiner* — Erika J Villaluna
(74) *Attorney, Agent, or Firm* — Venable LLP

(57) ABSTRACT

To provide a developer regulating member which can generate a uniform frictional charge even on a developer having a small size. A developer regulating member for regulating the thickness of the layer of a developer carried on the surface of a developer carrier, having: a regulating portion contacting with the developer, wherein the regulating portion includes a thermoplastic acrylic resin, and the thermoplastic acrylic resin has a first endothermic peak having a peak top at +50° C. or more and a second endothermic peak having a peak top at +20° C. or less on the differentiation curve of a DSC curve obtained when the temperature is raised from −100° C. to 150° C. at a rate of temperature rise of 20.0° C./min using differential scanning calorimetry (DSC).

15 Claims, 5 Drawing Sheets

DEVELOPER REGULATING MEMBER, DEVELOPING DEVICE, PROCESS CARTRIDGE AND ELECTROPHOTOGRAPHIC IMAGE FORMING APPARATUS

BACKGROUND OF THE INVENTION

Field of the Invention

The present disclosure relates to a developer regulating member, a developing device and a process cartridge used for an electrophotographic image forming apparatus and the electrophotographic image forming apparatus.

Description of the Related Art

Developing devices used for image forming apparatuses for electrophotography and having a developer carrier and a developer regulating member are known widely. The developer regulating member has the roles in forming a thin layer of a developer and imparting a frictional charge (triboelectric charge) to the developer on a regulating portion contacting with a developer carrier.

Japanese Patent Application Laid-Open No. 2000-39765 discloses a developer regulating member wherein a resin layer is formed on the surface of the developer regulating member, and the resin layer is a copolymer having at least a methyl methacrylate monomer and a nitrogen-containing vinyl monomer as monomer components. Japanese Patent Application Laid-Open No. 2000-39765 discloses that a stable charge having a large amount of electrification can be given to a developer on a developer carrier by the developer regulating member.

According to the examination of the present inventors, developers might not still be able to be triboelectrified uniformly with the reduction in the particle sizes of developers in recent years even when a developer regulating member according to Japanese Patent Application Laid-Open No. 2000-39765 was used. Shortage of the amount of developers electrified results in fog in electrophotographic images.

SUMMARY OF THE INVENTION

One aspect of the present disclosure is directed to providing a developer regulating member which enables generating a uniform frictional charge on a developer. Another aspect of the present disclosure is directed to providing a developing device which enables forming a high-definition electrophotographic image. Still another aspect of the present disclosure is directed to providing a process cartridge which contributes to the formation of a high-definition electrophotographic image. Yet another aspect of the present disclosure is directed to providing an electrophotographic image forming apparatus which enables forming a high-definition electrophotographic image.

According to one aspect of the present disclosure, there is provided a developer regulating member for regulating the thickness of the layer of a developer carried on the surface of a developer carrier, having: a regulating portion contacting with the developer, wherein the regulating portion contains a thermoplastic acrylic resin, and the thermoplastic acrylic resin has a first endothermic peak having a peak top at +50° C. or more and a second endothermic peak having a peak top at +20° C. or less on the differentiation curve of a DSC curve obtained when the temperature is raised from −100° C. to 150° C. at a rate of temperature rise of 20.0° C./min using differential scanning calorimetry (DSC).

According to another aspect of the present disclosure, there is provided a developing device, including: a developer carrier; a developer regulating member disposed in contact with the surface of the developer carrier; and a developer container storing a developer, wherein the developer regulating member is the above-mentioned developer regulating member.

According to yet another aspect of the present disclosure, there is provided a process cartridge detachably attachable to the body of an electrophotographic image forming apparatus, the process cartridge including: a developer carrier; a developer regulating member disposed in contact with the surface of the developer carrier; and a developer container storing a developer, wherein the developer regulating member is the above-mentioned developer regulating member.

According to yet another aspect of the present disclosure, there is provided an electrophotographic image forming apparatus, including: a developer carrier; a developer regulating member disposed in contact with the surface of the developer carrier; and a developer container storing a developer, wherein the developer regulating member is the above-mentioned developer regulating member.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

Embodiments of the present disclosure will be described hereinafter, but the present disclosure is not limited thereto.

[Developer Regulating Member]

A developer regulating member is a member which regulate the thickness of the layer of a developer carried on the surface of a developer carrier. The developer regulating member has a regulating portion contacting with the developer. The regulating portion contains a thermoplastic acrylic resin. This thermoplastic acrylic resin has a first endothermic peak and a second endothermic peak on the differentiation curve of a DSC curve obtained when the temperature is raised from −100° C. to 150° C. at a rate of temperature rise of 20.0° C./min using differential scanning calorimetry (DSC) The first endothermic peak is an endothermic peak having a peak top at +50° C. or more on this differentiation curve, and the second endothermic peak is an endothermic peak having a peak top at +20° C. or less on this differentiation curve. The temperatures of the endothermic peaks correspond to glass transition points on the differentiation curve.

—Thermoplastic Acrylic Resin

At least one first endothermic peak having a peak top at +50° C. or more, preferably +100° C. or more, and at least one second endothermic peak having a peak top at +20° C. or less, at preferably 0° C. or less, exist on the differentiation curve of the thermoplastic acrylic resin. Typically, only one endothermic peak having a peak top at +50° C. or more exists, and only one endothermic peak which has a peak top at +20° C. or less exists on the differentiation curve.

Examples of the thermoplastic acrylic resin having a first endothermic peak and a second endothermic peak on the differentiation curve include: i) a thermoplastic acrylic resin containing a first polymer exhibiting the first endothermic peak and a second polymer exhibiting the second endothermic peak; and ii) a thermoplastic acrylic resin which is a block copolymer having a first polymer block exhibiting the first endothermic peak and a second polymer block exhibiting the second endothermic peak.

Hereinafter, the polymer or the polymer block causing the first endothermic peak may be referred to as a first component, and the polymer or the polymer block causing the second endothermic peak may be referred to as a second component.

Figure 1:
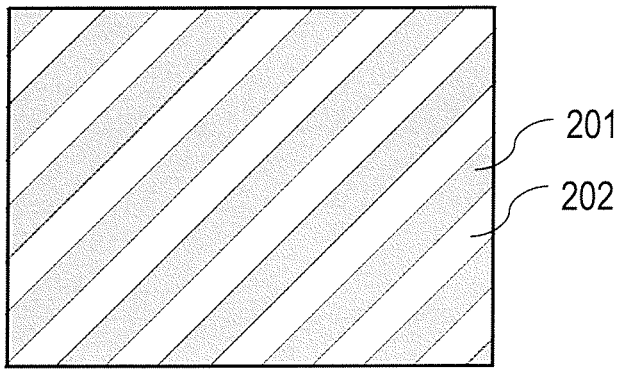
FIG. 1 is a schematic diagram illustrating an example of the phase separation structure of a thermoplastic acrylic resin.

FIG. 1 shows an example of a phase separation structure of the thermoplastic acrylic resin. In this example, a first component 201 and a second component 202 form a phase separation structure. The phase separation structure is observed using a transmission electron microscope (TEM), for example. When a hydrophilic dyeing agent such as phosphotungstic acid is used under TEM observation, the phase separation structure can be identified by the light and darkness of the observed components.

The present inventors have found that when the first and second endothermic peaks exist on the differentiation curve of the thermoplastic acrylic resin contained in a regulating portion, the surface of a developer is triboelectrified uniformly to suppress the shortage of the charge of the developer, and that as a result, fog hardly occurs. A reason that the shortage of the charge of the developer is suppressed is presumed as follows.

While the developer passes the developer regulating member in actual use of the developer regulating member, the developer contacts with the thermoplastic acrylic resin forming the surface of the regulating portion of the developer regulating member, and the developer rolls on the thermoplastic acrylic resin. Since the surface of the developer is triboelectrified uniformly by this rolling of the developer, the shortage of the charge of the developer is suppressed. The rolling of the developer on the thermoplastic acrylic resin results from the formation of the phase separation structure in which the first component and the second component of the thermoplastic acrylic resin are incompatible with each other.

If an endothermic peak exists only at +50° C. or more on the differentiation curve, the thermoplastic acrylic resin is glassy to thereby increase the hardness of the surface of the regulating portion at a temperature in the time of actual use, for example, room temperature (25° C.), and as a result, the developer easily slides. Therefore, the developer only moves while sliding on the surface of the regulating portion during the passage of the developer through the developer regulating member, and the developer hardly rolls on the surface of a regulating portion. The surface of the developer is therefore triboelectrified ununiformly.

If an endothermic peak exists only at +20° C. or less on the differentiation curve, the surface of the regulating portion containing a thermoplastic acrylic resin increases in tackiness, and the developer easily adheres to the surface of the regulating portion. The developer therefore adheres to the surface of a regulating portion during the passage of the developer through the developer regulating member, and the developer hardly rolls on the surface of the regulating portion. The surface of the developer is consequently triboelectrified ununiformly.

The present inventors have found that the ease of sliding and the adhesion of the developer on the regulating portion of a developer regulating member can be designed in a suitable range when first and second endothermic peaks exist. Therefore, the developer can be satisfactorily rolled on the regulating portion, and the surface of the developer can be triboelectrified uniformly.

The thermoplastic acrylic resin can be a mixture of, for example, i) a first polymer exhibiting a first endothermic peak and a second polymer exhibiting a second endothermic peak as described above. When the thermoplastic acrylic resin is such a thermoplastic resin, one polymer is dispersed in the other polymer in the mixture of the first polymer and the second polymer, for example.

The thermoplastic acrylic resin can be, for example, ii) a block copolymer having a first polymer block exhibiting a first endothermic peak and a second polymer block exhibiting a second endothermic peak. When the thermoplastic acrylic resin is such a block copolymer, the thermoplastic acrylic resin can be, for example, an A-B type block copolymer or an A-B-A type block copolymer, wherein the block copolymer includes a polymer block A and a polymer block B in one molecule, a polymer block A being derived from a single type of monomer and a polymer block B being derived from a single type monomers different from the monomer for A. In this case, one of the polymer blocks A and B is the first polymers block, and the other is the second polymer block.

It is preferable that the thermoplastic acrylic resin be the above-mentioned ii).

Monomer units constituting the thermoplastic acrylic resin are chemically bound in the block copolymer. Therefore, even after the block copolymer is made into the regulating portion of the developer regulating member, a micro phase separation designed at polymerization can be maintained more stably in the block copolymer. In the case of the block copolymer, satisfactorily rolling of the developer is accordingly maintained easily on the regulating portion, and thus it is easy to uniformly maintain the triboelectrification of the surface of the developer.

By performing Kendrick mass defect (KMD) analysis on a mass spectrum (MS) by measurement such as matrix assisted laser desorption/ionization time of flight mass spectrometry (MALDI-TOFMS), it can be confirmed whether the thermoplastic acrylic resin is a block copolymer or not.

The first component of the thermoplastic acrylic resin is a first polymer or a first polymer block synthesized, for example, from a methacrylate ester or acrylate ester monomer (and having an endothermic peak at +50° C. or more on the differentiation curve). The second component is a second polymer or a second polymer block synthesized, for example, from a methacrylate ester or acrylate ester monomer (and having an endothermic peak at +20° C. or less on the differentiation curve).

Examples of the monomer used for synthesizing the first component include methacrylate ester such as methyl methacrylate, ethyl methacrylate, isopropyl methacrylate, isobutyl methacrylate, sec-butyl methacrylate, tert-butyl methacrylate, cyclohexyl methacrylate, isobornyl methacrylate, phenyl methacrylate and 2-hydroxyethyl methacrylate; and acrylate ester such as methyl acrylate, tert-butyl acrylate, cyclohexyl acrylate, isobornyl acrylate, phenyl acrylate and 2-hydroxyethyl acrylate.

Methyl methacrylate is preferably used as the monomer used for synthesizing the first component among these. That is, it is preferable that the first component include a repeating unit derived from methyl methacrylate.

Examples of the monomer used for synthesizing the second component include methacrylate ester such as n-propyl methacrylate, n-butyl methacrylate, isobutyl methacrylate, amyl methacrylate, isoamyl methacrylate, n-hexyl methacrylate, 2-ethylhexyl methacrylate, pentadecyl methacrylate, dodecyl methacrylate, phenoxy ethyl methacrylate and 2-methoxy ethyl methacrylate; and acrylate ester such as methyl acrylate, ethyl acrylate, n-propyl acrylate, isopropyl acrylate, n-butyl acrylate, isobutyl acrylate, sec-butyl acrylate, amyl acrylate, isoamyl acrylate, n-hexyl acrylate, 2-ethylhexyl acrylate, pentadecyl acrylate, dodecyl acrylate, benzyl acrylate, phenoxy ethyl acrylate and 2-methoxy ethyl acrylate.

n-Butyl acrylate or 2-ethylhexyl acrylate is preferably used as the monomer used for synthesizing the second component among these. That is, it is preferable that the second component include a repeating unit derived from n-butyl acrylate or 2-ethylhexyl acrylate.

When the thermoplastic acrylic resin is a mixture of the first polymer and the second polymer, it is preferable that the weight average molecular weight Mw of the first polymer (the first component) be $1\times10^4$ or more and $5\times10^4$ or less. In this case, the developer is rolled satisfactorily during the passage of the developer through the developer regulating member to thereby triboelectrify the surface of the developer more uniformly, and the shortage of the charge of the developer is therefore suppressed.

When the thermoplastic acrylic resin is a mixture of the first polymer and the second polymer, it is preferable that the weight average molecular weight Mw of the second polymer (the second component) be $1\times10^4$ or more and $1\times10^5$ or less. In this case, the developer is rolled satisfactorily during the passage of the developer through the developer regulating member to thereby triboelectrify the surface of the developer more uniformly, and the shortage of the charge of the developer is therefore suppressed.

It is preferable that the weight average molecular weight Mw of the block copolymer be $1\times10^4$ or more and $9\times10^5$ or less. In this case, the developer is rolled satisfactorily during the passage of the developer through the developer regulating member to thereby triboelectrify the surface of the developer more uniformly, and the shortage of the charge of the developer is therefore suppressed.

It is preferable that the content of the first component based on the total amount of the thermoplastic acrylic resin be 20% by mass or more and less than 80% by mass. It is accordingly preferable that the content of the first polymer based on the total amount of the thermoplastic acrylic resin or the content of the first polymers block based on the total amount of the block copolymer be in this range. In this case, the developer is rolled satisfactorily during the passage of the developer through the developer regulating member to thereby triboelectrify the surface of the developer more uniformly, and the shortage of the charge of the developer is therefore suppressed.

A typical configuration of a developer regulating member includes a regulating portion and a support member. Materials constituting a regulating portion and a support member may be the same material, or may be different materials from each other. As the support member, a member which can support the regulating portion can be used suitably. In embodiments illustrated hereinafter, the regulating portion and the support member are separate and independent from each other. However, the present disclosure is not limited to those having such a configuration, and both may be integrated.

Figure 2:
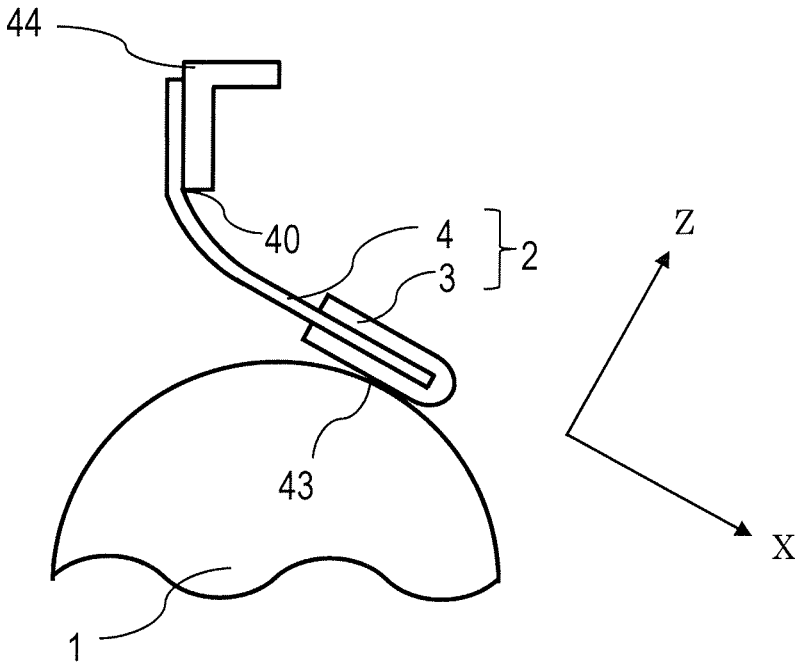
FIG. 2 is a cross-sectional schematic diagram for illustrating an example of a developer regulating member.
Figure 3:
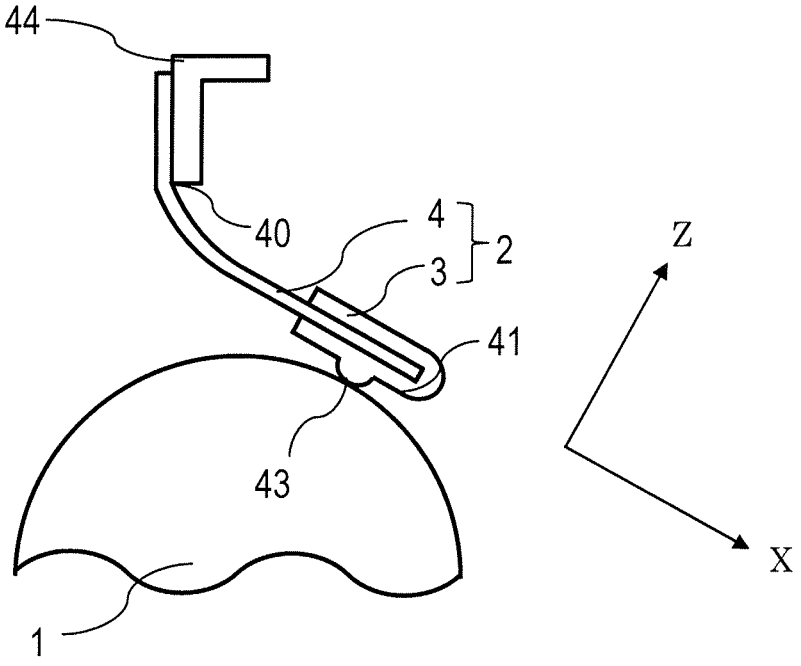
FIG. 3 is a cross-sectional schematic diagram for illustrating another example of the developer regulating member.
Figure 4:
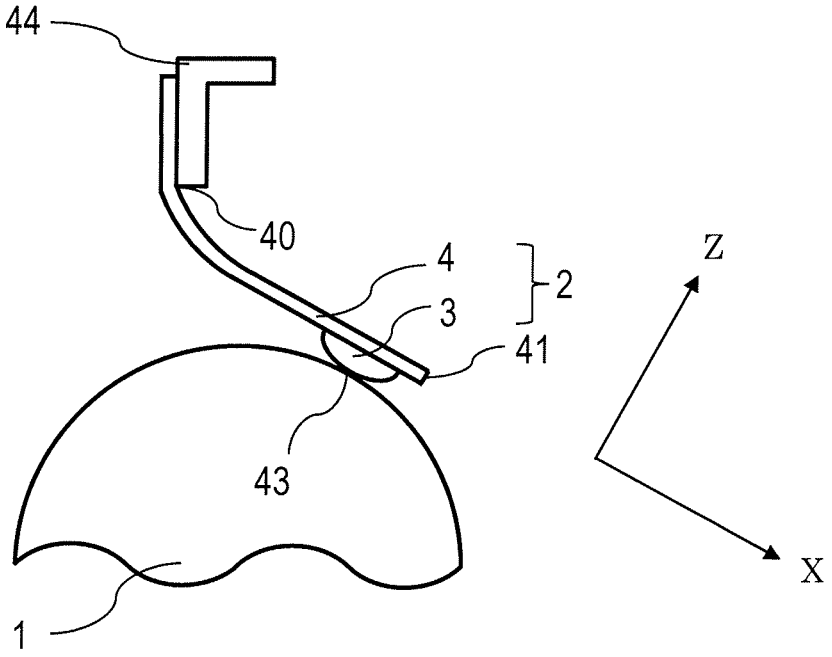
FIG. 4 is a cross-sectional schematic diagram for illustrating still another example of the developer regulating member.

Specific examples of the developer regulating member will be described with reference to FIGS. 2 to 4. A developer carrier 1 illustrated in FIGS. 2 to 4 is only a part thereof. The developer carrier 1 is a developer-carrying roller, and these figures show the section in the direction perpendicularly to the rotation axis of the developer-carrying roller. The "longitudinal direction" for the developer carrier 1 and a developer regulating member 2 means a direction parallel to the rotation axis of the developer-carrying roller (direction perpendicular to the sheets of FIGS. 2 to 4).

The developer regulating member 2 includes a regulating portion 3 and a support member 4. The support member 4 is a plate-like member extending in the longitudinal direction of the developer-carrying roller. The support member 4 allows the regulating portion 3 and a developer to contact to each other more stably to thereby triboelectrify the developer more uniformly, and the shortage of the charge of the developer is suppressed more easily. The developer regulating member 2 is fixed to a holder 44 with a fixed point 40 as a fulcrum, and is contacted with the surface of the developer carrier 1. The holder 44 is fixed to a developer container 6 described later. Because of such a configuration, the developer regulating member 2 easily forms an intake opening for introducing a suitable amount of the developer between the developer regulating member 2 and the developer carriers 1, and easily forms a uniform developer layer having an enough amount of electrification on the developer carrier. A contact portion 43 is a portion in which the regulating portion 3 contacts with the surface of developer carrier 1.

The regulating portion 3 can be disposed at an end of the support member 4 (FIGS. 2 and 3), or can be disposed near an end of support member 4 (FIG. 4). Specifically, as illustrated in FIGS. 2 and 3, the regulating portion 3 can be disposed so as to cover an end face in the transverse direction of the support member 4 (an end face in the X direction in FIGS. 2 and 3). At this time, not only the end face of the support member 4 but also a part of a contact support surface and a part of the surface opposite thereto are covered with the regulating portion 3. Here, the "contact support surface" is a surface on which the support member contacts with the developer (the developer carried on the surface of the developer carrier) through the regulating portion.

Alternatively, as illustrated in FIG. 4, the regulating portion 3 may be formed only on the contact support surface. In FIG. 4, the regulating portion 3 is disposed at a predetermined distance from the end face of the support member 4. Also, when the regulating portion is formed only on the contact support surface, the regulating portion 3 may however reach the end face.

The shape of the contact portion of the regulating portion is not particularly limited, and may be a flat surface, a curved surface, a convex shape, a concave shape or the like.

As illustrated in FIGS. 3 and 4, the developer regulating member 2 can have a projection 41. The regulating portion 3 contacts with the developer (developer carried on the surface of the developer carrier) on the contact portion 43. The projection 41 is a portion extending from the contact portion 43 toward a side for feeding the developer to the contact portion 43 (in the X direction in FIGS. 3 and 4). A step 41 in the thickness direction of the support member (in the Z direction in FIGS. 3 and 4) is formed over a region from the contact portion 43 to the projection. The projection does not contact with the developer. The support member 4 can extend to the position of the projection 41.

The presence of the projection 41 facilitates taking in the developer between the developer carrier 1 and the developer regulating member 2, and the developer is further compacted and triboelectrified in this intake space. The developer strongly packed between the surface of developer carrier 1 and the projection 41 may push up the surface of the projection. A step however enables securing an edge portion which regulates the thickness of the developer layer, and the thickness of the developer layer can therefore be regulated still more surely.

In the examples shown in FIGS. 3 and 4, the developer regulating member 2 includes a convex portion forming the contact portion 43. The convex portion is a part of the regulating portion 3 (see FIG. 3) or the whole of the regulating portion 3 (see FIG. 4).

[Regulating Portion]

A regulating portion used for the above-mentioned developer regulating member is formed of a main material which is a resin material containing a thermoplastic acrylic resin, and is formed on a support member.

It is preferable that the thickness of a regulating portion 3 be 1 μm or more and 1000 μm or less on the contact support surface of a support member 4. When the thickness is 1 μm or more, it is easy to make the durability to abrasion by friction with a developer carrier good. When the thickness is 1000 μm or less, it is easy to obtain stable contact pressure between the regulating portion and the developer carrier. The thickness of the regulating portion 3 herein means the distance from the contact support surface of the support member 4 to the contact portion 43.

The regulating portion can be formed by extrusion, coating, sheet lamination, injection molding or the like. Specifically, when the regulating portion is formed by extrusion, a support member coated with adhesives if needed is placed in a molding die, and a heat-melted material for the regulating portion is injected into the molding die and extruded together with the support member. When the regulating portion is formed by coating, a material for the regulating portion dispersed in a solvent is applied to a support member with a coating apparatus such as a spray, and the solvent is dried to form a regulating portion on the support member. When the regulating portion is formed by sheet lamination, a sheet formed of a material for the regulating portion by extrusion or the like is laminated on a support member coated with an adhesive to form a regulating portion. When the regulating portion is formed by injection molding, a material for the regulating portion is injected into a mold cavity and cooled to form a regulating portion.

When the regulating portion is formed, an adhesives layer can be formed on a support member if needed. Examples of the material of an adhesives layer include adhesives such as polyurethanes, polyesters, ethylene-vinyl alcohol (EVA) and polyamides as a hot melt type.

[Support Member]

Examples of the material of a support member include, but are not particularly limited to, metals such as steel sheets surface-treated with chromate, lubrication resin or the like, stainless steel, phosphor bronze and aluminum; and resins such as acrylic resins, polyethylene resins and polyester resins. When electroconductivity is required in the case of using a resin, it is preferable to add an electroconductive material to the resin.

It is preferable that the thickness of a plate-like support member (distance in the Z direction in FIGS. 2 to 4) be 0.05 mm or more and 3 mm or less. Especially when the support member is a thin plate of 0.05 mm or more and 0.15 mm or less in thickness, the support member has a moderate spring characteristic. It is therefore easy to contact a regulating portion with a developer carrier at a suitable contact pressure, and it is thus easy to regulate a developer on the developer carrier to a suitable layer thickness. When the thickness of the support member is 0.8 mm or more, it is easy to attach a developer regulating member to a developing device, a process cartridge and an electrophotographic image forming apparatus, set its location and dispose the developer regulating member without distortion or the like. Therefore, the regulating portion is easily contacted with the developer carrier stably at a proper contact pressure.

When the material of the support member is metal, the support member can be formed by a method such as bending such as pressing; electrochemical machining; electric discharge machining or laser beam machining.

When the material of the support member is a thermoplastic resin, the support member can be formed, for example, by extrusion or injection molding. Specifically, when the support member is formed by extrusion, a heat-melted thermoplastic resin can be injected into a molding die to form a support member. When the support member can be formed by injection molding, a thermoplastic resin can be injected into a mold cavity and cooled to form a support member.

When the obtained developer regulating member is incorporated into an electrophotographic image forming apparatus, the developer regulating member may be attached to a holder 44 as illustrated in FIG. 2, FIG. 3 and FIG. 4. The regulating portion 3 of a developer regulating member 2 may be directly bonded to the holder 44, and as illustrated in FIG. 2, FIG. 3 and FIG. 4, a support member 4 may be bonded. Bonding can be performed by a proper method such as the use of adhesives or welding. For example, when the support member 4 is welded to the holder, the support member 4 can be welded by irradiating in the shape of spots or a line using YAG laser, fiber laser or the like.

[Electroconductive Agent]

An electroconductive agent can be included in a regulating portion, a support member and an adhesives layer if needed. Examples of the electroconductive agent include an ionic electroconductive agent and an electronic electroconductive agent such as carbon black.

Specific examples of the carbon black include "KETJENBLACK" (trade name, produced by LION SPECIALTY CHEMICALS CO., LTD.), electroconductive carbon black such as acetylene black, and carbon black for rubber such as SAF, ISAF, HAF, FEF, GPF, SRF, FT and MT.

Besides, oxidation-treated carbon black for color ink and pyrolytic carbon black can be used. It is preferable that the amount of carbon black used be 5 parts by mass or more and 50 parts by mass or less based on 100 parts by mass of a thermoplastic acrylic resin. The content of carbon black in the resin can be measured using a thermogravimetric analysis apparatus (TGA).

Examples of an electronic electroconductive agent which can be used besides the above-mentioned carbon black include the following: graphite such as natural graphite and artificial graphite; metal powders such as copper, nickel, iron and aluminum; metal oxide powders such as titanium oxide, zinc oxide and tin oxide; and electroconductive polymer compounds such as polyaniline, polypyrrole and polyacetylene. These can be used singly or in combination of two or more if needed.

Examples of the ionic electroconductive agent include the following:

a perchlorate, a chlorate, a hydrochloride, a bromate, an iodate, a borofluoride, trifluoromethylsulfate, a sulfonate or a bis(trifluoromethylsulfonyl)imide salt containing an ammonium ion such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium or modified aliphatic dimethylethylammonium; and a perchlorate, a chlorate, a hydrochloride, a bromate, an iodate, a borofluoride, trifluoromethylsulfate, a sulfonate or a bis(trifluoromethylsulfonyl)imide salt containing an alkaline metal or an alkaline-earth metal such as lithium, sodium, calcium or magnesium.

Trifluoromethylsulfate and a bis(trifluoromethylsulfonyl) imide salt of an alkaline metal or an ammonium ion are particularly preferable. Since these salts have structures containing fluorine in an anion, the salts have a great effect of imparting electroconductivity, and is therefore preferred. These can be used singly or in combination of two or more if needed.

A charge control agent, a lubricant, a filler, an antioxidant and an age resistor can be incorporated into the regulating portion, the support member and the adhesives layer besides as long as the functions of the above-mentioned resin and electroconductive agent are not hindered

[Developing Device]

Figure 5:
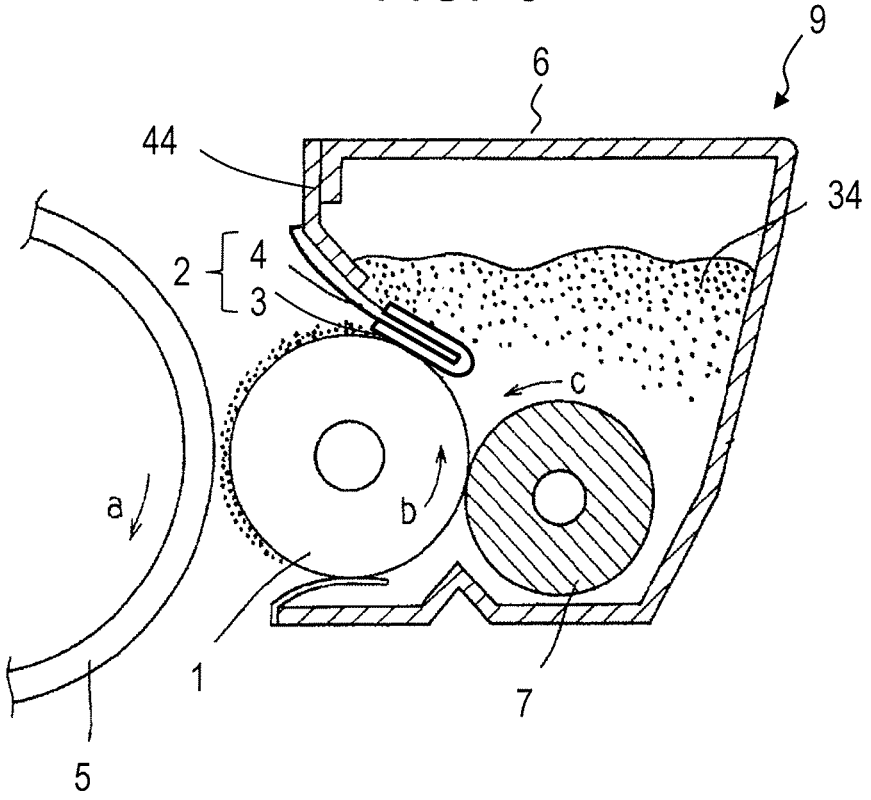
FIG. 5 is a cross-sectional schematic diagram illustrating an example of a developing device.

FIG. 5 illustrates an example of a developing device. This developing device 9 has: a developer container 6 storing a developer 34; a developer carrier 1 conveying the developer 34; and a developer regulating member 2 regulating the thickness of a developer layer on the surface of the developer carrier 1. A developer feeding roller 7 and the like may be included if needed.

In such a developing device 9, while the developer feeding roller 7 rotates in the direction of the arrow c, the developer carrier 1 rotates in the direction of the arrow b, to thereby crimp the developer 34 on the developer carrier 1.

The developer 34 crimped on the developer carrier enters between the developer regulating member 2 and the developer carrier 1 with the rotation of the developer carrier 1 in the direction of the arrow b. When the developer 34 passes here, the developer 34 is rubbed by the surface of the developer carrier 1 and the regulating portion 3 of the developer regulating member 2 and thus electrified.

The electrified developer 34 forms a thin layer on the surface of the developer carrier 1, and is conveyed out of the developer container 6 with the rotation of the developer carrier 1. The developer on the surface of the developer carrier 1 moves to the electrostatic latent image of a photoconductor (electrostatic latent image carrier) 5 which rotates in the direction of the arrow a, and adheres to an electrostatic latent image, which is developed as a developer image (toner image) and visualized. A developer which is not consumed by the development of the electrostatic latent image and therefore remains on the developer carrier 1 are collected in the developer container 6 from the bottom of the developer carrier with the rotation of the developer carrier 1 and stripped from the developer carrier 1 on a nip portion with the developer feeding roller 7. A new developer 34 in the developer container is simultaneously fed to the developer carrier 1 by the rotation of the developer feeding roller 7. Meanwhile, most of the developer 34 stripped from the developer carrier 1 is conveyed to the developer container 6 with the rotation of the developer feeding roller 7 and mixed with a developer therein, and its electrification charge is distributed.

[Process Cartridge]

Figure 6:
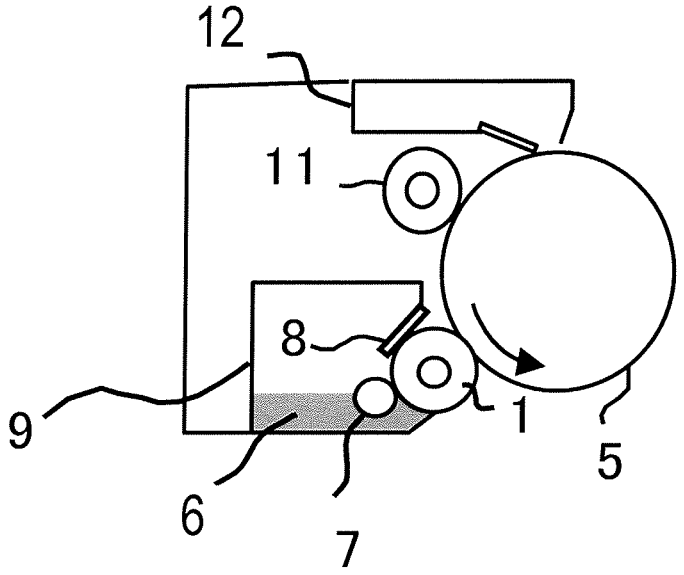
FIG. 6 is a cross-sectional schematic diagram illustrating an example of a process cartridge.

A process cartridge has the developing device, and are configured to be detachably attachable to the body of an electrophotographic image forming apparatus. FIG. 6 illustrates an example of the process cartridge.

The process cartridge shown in FIG. 6 has a developing device 9, a photoconductor 5, a cleaning apparatus 12 and an electrifying apparatus 11 that are integrated, and is detachably and attachably provided on the body of an electrophotographic image forming apparatus. The same apparatus as the image forming unit of the electrophotographic image forming apparatus described below can be used as the developing device 9. The process cartridge can also be configured to be integrally provided with a transfer member and the like which transfers a developer image on the photoconductor to a recording material together with the above-mentioned members besides the above-mentioned configuration.

[Electrophotographic Image Forming Apparatus]

Figure 7:
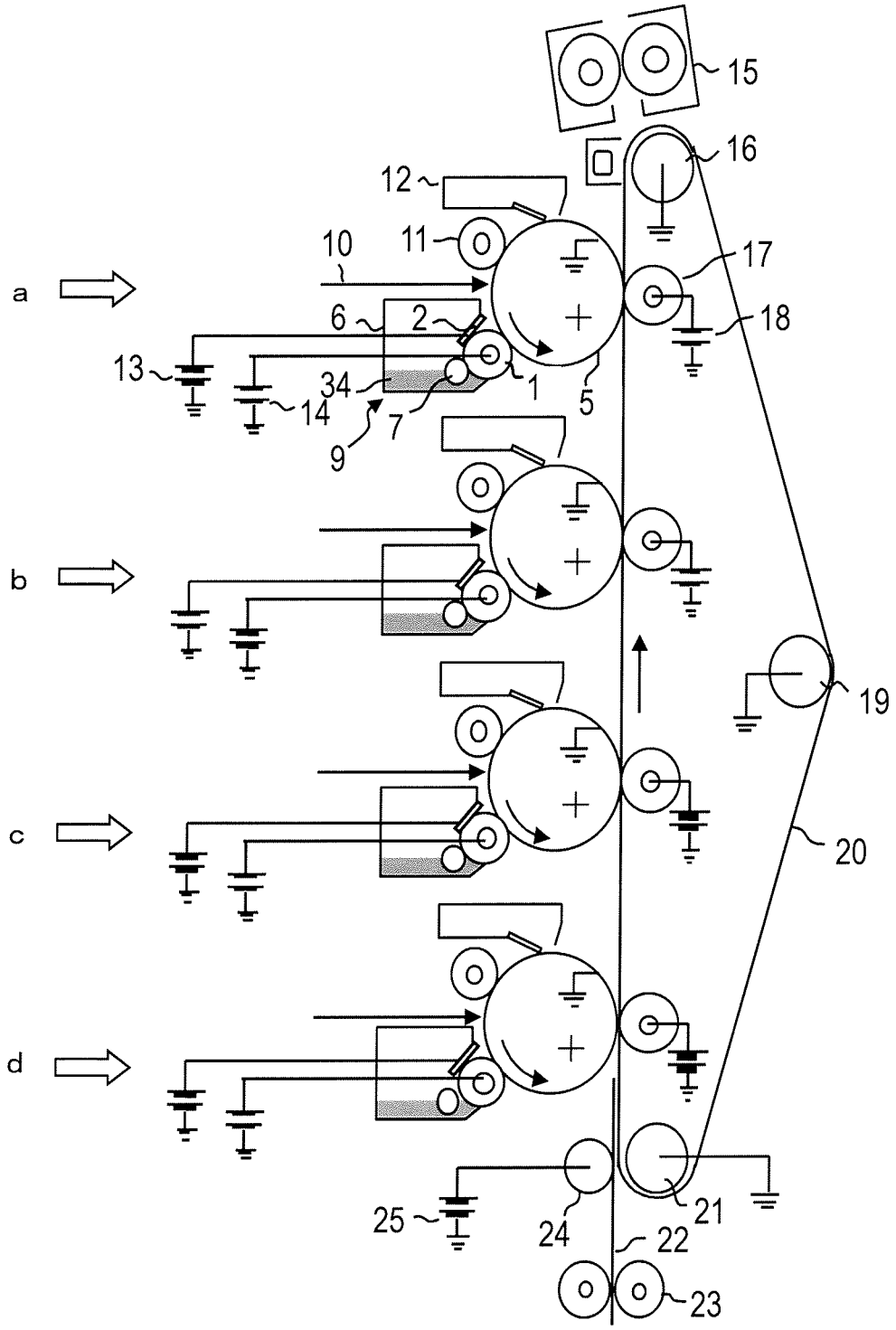
FIG. 7 is a cross-sectional schematic diagram illustrating an example of an electrophotographic image forming apparatus.

An electrophotographic image forming apparatus has the developing device. FIG. 7 illustrates an example of the electrophotographic image forming apparatus.

In FIG. 7, image forming units a to d are provided for color developers which are a yellow toner (developer), a magenta toner (developer), a cyan toner (developer) and a black toner (developer), respectively. A photoconductor 5 as an electrostatic latent image carrier which rotates in the direction of an arrow respectively is provided in each of the image forming units a to d. An electrifying apparatus 11 for electrifying each photoconductor 5 uniformly, an exposure unit irradiating the photoconductor 5 subjected to electrification treatment with a laser beam 10 to form an electrostatic latent image and not illustrated, and a developing device 9 feeding a developer to the photoconductor 5 forming the electrostatic latent image and developing the electrostatic latent image are provided around each photoconductor 5.

Meanwhile, a transfer conveyance belt 20 for conveying a recording material 22 such as paper fed by a feeding roller 23 is provided and suspended on a driving roller 16, a driven roller 21 and a tension roller 19. The electrophotographic image forming apparatus is configured to apply the charge from an attraction bias power supply 25 to the transfer conveyance belt 20 through an attracting roller 24 and adhere the recording material 22 to the surface of the transfer conveyance belt 20 electrostatically to convey the recording material 22. The transfer conveyance belt 20 can be moved while synchronizing with the image forming units a to d.

A transfer bias power supply 18 is provided which applies a charge for transferring a developer image on the photoconductor 5 of each of the image forming units a to d to a recording material 22. Transfer bias is applied through a transfer roller 17 disposed on the rear surface of the transfer conveyance belt 20. The developer images of respective colors formed in the image forming units a to d are superimposed one by one on the recording material 22 conveyed by the transfer conveyance belt 20 and transferred to the recording material 22.

A fixing apparatus 15 for fixing the developer image superimposed and transferred on the recording material 22 by heating or the like and a conveying apparatus for ejecting the recording material 22 on which an image is formed out of the apparatus (not illustrated) are further provided in the color electrophotographic image forming apparatus.

Meanwhile, a cleaning apparatus 12 having a cleaning blade for removing a residual developer which is not transferred to each photoconductor 5 and thus remains thereon and cleaning the surface thereof is provided in each image forming unit. The cleaned photoconductor 5 becomes image formable so as to stand by.

A developer container 6 storing the developer is provided in the developing device 9 provided in each of the above-mentioned image forming units. A developer carrier 1 is provided in the developing device 9 so as to blockade the opening of the developer container and oppose the photoconductor 5 in a portion exposed from the developer container.

A developer feeding roller 7 for scraping the developer which is not used to remain on the developer carrier 1 after development while feeding the developer 34 to the developer carrier 1 is provided in the developer container. A developer regulating member 2 forming a thin film of the developer on the developer carrier 1 and triboelectrifying the developer is provided in the developer container. These are disposed in contact with respective developer carriers 1. The developer carrier 1 and the developer feeding roller 7 rotate in the forward direction.

A predetermined voltage is applied on the developer carrier 1 from a developer carrier bias power supply 14. A predetermined voltage is applied on the developer regulating member 2 from a developer regulating member bias power supply 13.

[E-Spart Method]

As a method for measuring the variation in the developer charge, known is measurement the distribution of the amount of electrification by the E-spart method, which uses a laser Doppler charge measuring method (trade name: E-spart Analyzer, manufactured by HOSOKAWA MICRON CORPORATION). Since the amount of electrification of a developer electrified is measured in an air flow in the E-spart method, useful information for grasping a development state is obtained. The E-spart method is effective especially as a technique for evaluating fog resulting from the shortage of the charge of the developer. According to the examination of the present inventors, good correlation between the ratio (%) of the number of low triboelectric charge developer particles, which have 30% or less of the peak charge amount, and fog resulting from the shortage of the charge of the developer is obtained.

According to one aspect of the present disclosure, a developer regulating member which can generate a uniform frictional charge even on a developer having a small size can be obtained. According to another aspect of the present disclosure, a developing device which can form a high-definition electrophotographic image can be obtained. According to still another aspect of the present disclosure, a process cartridge which contributes to the formation of a high-definition electrophotographic image can be obtained. According to yet another aspect of the present disclosure, an electrophotographic image forming apparatus which can form a high-definition electrophotographic image can be obtained.

EXAMPLES

The present disclosure will be described specifically hereinafter by way of Examples, but the present disclosure is not limited thereto.

Example 1

1. Production of Thermoplastic Acrylic Resin Coating Liquid

A resin X, a resin Y, and electroconductive carbon black illustrated below were added to toluene.

Resin X: Methyl methacrylate polymer (Mw=25200), 50 parts by mass

Resin Y: n-butyl acrylate polymer (Mw=55100), 50 parts by mass

Electroconductive carbon black: produced by Denka Company Limited., trade name: DENKA BLACK (indicated by "CB" in Table 2), 20 parts by mass.

This mixture was dispersed for 2 hours with a sand mill (a glass bead of 1 mm in diameter was used as a media particle), the glass bead was separated using a sieve, and ethyl acetate was then added so that the solid content concentration is 33% by mass to produce a thermoplastic acrylic resin coating liquid.

2. Manufacturing of Developer Regulating Member

A regulating portion was formed on the surface of a support member using the above-obtained coating liquid. A phosphor bronze plate having spring elasticity (0.12 mm in plate thickness, 22 mm in width (length in the transverse direction), 210 mm in the length on a side coated with a resin coating liquid (length in the longitudinal direction)) was used for the support member. This support member was fixed with the longitudinal direction vertical, the above-obtained thermoplastic acrylic resin coating liquid was applied with a spray gun moved down at a fixed speed, and coat films having a uniform film thickness were formed on the surfaces (both sides) of the support member. These were further dried and cured at 160° C. for 30 minutes in a drying furnace to form a regulating portion, and a developer regulating member having the structure illustrated in FIG. 2 was obtained. The thickness of the regulating portion 3 was 10 μm. The regulating portion 3 was provided so as to extend in the width direction of the support member in the area from the end of the support member to 3 mm apart from the end.

3. <Measurement 1: Measurement of Endothermic Peak Temperature of Thermoplastic Acrylic Resin>

According to Japanese Industrial Standards (JIS) K6240: 2011, DSC measurement was performed using the differential scanning calorimeter (trade name: DSC Q2000, manufactured by TA Instruments Japan Inc.). At this time, 5.0 mg of a sample obtained by exfoliating from a regulating portion was weighed in an aluminum pan, and the temperature thereof was raised from −100° C. to 150° C. at a rate of temperature rise of 20.0° C./min. The endothermic peak was calculated from a differentiation curve obtained by differentiating a DSC curve obtained by DSC measurement. Two endothermic peaks existed on the differentiation curve. A peak having a higher endothermic peak temperature (the temperature of the peak top) was designated as a peak A, and a peak having a lower endothermic peak temperature was designated as a peak B, among these.

As a result of measurement on the manufactured developer regulating member, the temperature of the peak A was +115° C., and the temperature of the peak B was −56° C. Table 2 shows the measurement result.

4. <Measurement 2: Measurement of Molecular Weight of Thermoplastic Acrylic Resin>

The weight average molecular weight Mw was measured using a high-speed GPC apparatus (trade name: HLC-8320GPC, manufactured by Tosoh Corporation). At this time, a sample obtained by exfoliating from a regulating portion was dissolved in tetrahydrofuran (THF) eluate at a concentration of 0.5% by mass, and the resultant was used as a measuring object. Measurement was performed at a flow rate of 0.6 mL/min using two columns (trade name: TSKgel SuperHM-M, manufactured by Tosoh Corporation), and the weight average molecular weight Mw was calculated. The detector was an RI detector (differential refractometer), and the standard substance was polystyrene.

As a result of measurement on the manufactured developer regulating member, the Mw of the component of peak A was 25200, and the Mw of the component of peak Bs was 55100. Table 2 shows the measurement result. Among resins forming a regulating portion, a component exhibiting the peak A is called a "component of peak A", and a component exhibiting the peak B is called a "component of peak B". The component of peak A corresponds to the resin X, and the component of peak B corresponds to the resin Y. In Table 1, the Mw of the component of peak A is shown in the space of "Mw of resin X", and the Mw of the component of peak B is shown in the space of "Mw of resin Y".

5. <Measurement 3: Measurement of Component Content of Thermoplastic Acrylic Resin>

The chemical structures of the component of peak A and the component of peak B were identified, and the mass ratio of monomers constituting these components was measured, using a nuclear magnetic resonance apparatus (trade name: ECX5002, manufactured by JEOL RESONANCE Inc.). The measuring frequencies were 490 MHz ($^{1}$H) and 123 MHz ($^{13}$C), the solvent was heavy chloroform, and the standard substance was tetramethyl silane ($^{1}$H: 0 ppm $^{13}$C: 0 ppm) at this time. The measurement mode was $^{1}$H-NMR, H-H COSY, $^{13}$C-NMR, DEPT, HSQC, HMBC. The component contents (% by mass) were calculated from the mass ratio between the monomers.

As a result of measurement on the manufactured developer regulating member, the component of peak A was a methyl methacrylate polymer, the content was 50% by mass, the component of peak B was an n-butyl acrylate polymer, and the content was 50% by mass. Table 2 shows these contents.

6. Evaluation with Electrophotographic Image Forming Apparatus

The manufactured developer regulating member was incorporated into an electrophotographic image forming apparatus, and the performance and the image output were evaluated. A laser beam printer having a configuration illustrated in FIG. 7 (trade name: CLJ CP4525, manufactured by Hewlett-Packard Japan, Ltd.) was used as an electrophotographic image forming apparatus. The manufactured developer regulating member was first installed in the magenta cartridge of the electrophotographic image forming apparatus, and the apparatus was left to stand for 24 hours in the normal temperature and normal humidity environment, specifically, a temperature of 25° C. and a relative humidity of 55%.

Five sheets of white solid images were output at a speed of 10 sheets/min, the operation of the printer was then stopped in the middle of the output of one sheet of a white solid image, and the following evaluations were performed.

—<Evaluation 1: Developer Charge Amount>

A developer was sucked from a developer layer formed on a developer carrier using a nozzle for suction having an opening of 5 mm in diameter, and the amount of the charge of the developer sucked and the mass of the developer were measured to calculate the charge of the developer (μC/g). The amount of the charge was measured using a digital electrometer (trade name: 8252, manufactured by ADC CORPORATION).

As a result of measurement on the manufactured developer regulating member, the charge of the developer was 50 μC/g. Table 3 shows the evaluation result.

—<Evaluation 2: Distribution of Amount of Electrification of Developer Electrified>

In the measurement of the distribution of the amount of electrification of the developer electrified, the developer layer formed on the developer carrier was blown away with nitrogen gas using the E-spart Analyzer (trade name) of HOSOKAWA MICRON CORPORATION and introduced from sampling pores into a measurement part (measurement cell) of the measuring apparatus. The measurement was performed until 3000 particles of the developer were counted. The ratio (%) of the number of low triboelectric charge developer particles to all the developer particles analyzed using the E-spart Analyzer was calculated. The "low triboelectric charge developer" was defined as a developer having charge in an amount of 30% or less based on the peak charge amount (the maximum of the amount of the charge of the developer analyzed).

As a result of evaluation on the manufactured developer regulating member, the ratio of the low triboelectric charge developer particles was 0.6%. Table 3 shows the evaluation result.

—<Evaluation 3: Fog>

Toner adhering to a photoconductor was peeled and collected with a transparent tape (trade name: polyester tape No. 550, manufactured by NICHIBAN CO., LTD.), and the tape was pasted on white paper (trade name: Business Multipurpose 4200, manufactured by Fuji Xerox Co., Ltd.) to obtain a sample for evaluation. The reflection density of the sample for evaluation (R1) was subsequently measured with a reflection densitometer (trade name: TC-6DS/A, manufactured by Tokyo Denshoku. CO., LTD.). A green filter was used for a filter at that time. Separately, the reflection density (R0) was measured in the same manner on a standard sample obtained by pasting only the transparent tape on white paper. The decrement of the reflectance of the sample for evaluation based on the standard sample, "R0−R1" (%), was defined as a fog value (%).

As a result of evaluation on the manufactured developer regulating member, the fog was 0.7%. Table 3 shows the evaluation result.

Examples 2 to 8, 11 to 13, 17 to 22 and Comparative Examples 1 to 7

Developer regulating members were manufactured in the same manner as in Example 1 except that at least one of the material of a resin X, the material of a resin Y, and the numbers of the parts of the resin X and the resin Y added was changed as shown in Table 1, and the developer regulating members were subjected to Measurement 1 to Measurement 3 and Evaluation 1 to Evaluation 3 described in Example 1.

TABLE 1

| | | Resin X | | | Resin Y | | |
|---|---|---|---|---|---|---|---|
| | | Material | Mw | Parts by mass | Material | Mw | Parts by mass |
| Example | 1 | Methyl methacrylate polymer | 25200 | 50 | n-Butyl acrylate polymer | 55100 | 50 |
| | 2 | Ethyl methacrylate polymer | 25200 | 50 | n-Butyl acrylate polymer | 55100 | 50 |
| | 3 | Methyl methacrylate polymer | 25200 | 50 | Methyl acrylate polymer | 55100 | 50 |
| | 4 | Ethyl methacrylate polymer | 25200 | 50 | Methyl acrylate polymer | 55100 | 50 |
| | 5 | Methyl methacrylate polymer | 10600 | 50 | n-Butyl acrylate polymer | 55100 | 50 |
| | 6 | Methyl methacrylate polymer | 49000 | 50 | n-Butyl acrylate polymer | 55100 | 50 |
| | 7 | Methyl methacrylate polymer | 25200 | 50 | n-Butyl acrylate polymer | 10200 | 50 |
| | 8 | Methyl methacrylate polymer | 25200 | 50 | n-Butyl acrylate polymer | 99700 | 50 |
| | 11 | Methyl methacrylate polymer | 25200 | 20 | n-Butyl acrylate polymer | 55100 | 80 |
| | 12 | Methyl methacrylate polymer | 25200 | 80 | n-Butyl acrylate polymer | 55100 | 20 |
| | 13 | Methyl methacrylate polymer | 25200 | 50 | 2-Ethylhexyl acrylate polymer | 55100 | 50 |
| | 17 | Methyl methacrylate polymer | 8700 | 50 | n-Butyl acrylate polymer | 55100 | 50 |
| | 18 | Methyl methacrylate polymer | 60000 | 50 | n-Butyl acrylate polymer | 55100 | 50 |
| | 19 | Methyl methacrylate polymer | 25200 | 50 | n-Butyl acrylate polymer | 9200 | 50 |
| | 20 | Methyl methacrylate polymer | 25200 | 50 | n-Butyl acrylate polymer | 110000 | 50 |
| | 21 | Methyl methacrylate polymer | 25200 | 18 | n-Butyl acrylate polymer | 55100 | 82 |
| | 22 | Methyl methacrylate polymer | 25200 | 82 | n-Butyl acrylate polymer | 55100 | 18 |
| Comparative Example | 1 | n-Butyl methacrylate polymer | 25200 | 50 | n-Butyl acrylate polymer | 55100 | 50 |
| | 2 | Methyl methacrylate polymer | 25200 | 50 | Ethyl methacrylate polymer | 55100 | 50 |
| | 3 | n-Butyl methacrylate polymer | 25200 | 50 | Methyl acrylate polymer | 55100 | 50 |
| | 4 | Methyl methacrylate polymer | 25200 | 100 | — | — | — |
| | 5 | n-Butyl acrylate polymer | 25200 | 100 | — | — | — |
| | 6 | Ethyl methacrylate polymer | 25200 | 100 | — | — | — |
| | 7 | n-Butyl methacrylate polymer | 25200 | 100 | — | — | — |

Example 9

First, 20 parts by mass of electroconductive carbon black (produced by Denki Kagaku Kogyo K.K., trade name: DENKA BLACK) was added to 100 parts by mass of the resin Z illustrated below.

Resin Z: Block copolymer of thermoplastic acrylic resins (Mw=56500, produced by KURARAY CO., LTD., trade name: KURARITY LA4285).

The obtained mixture was subjected to melt kneading at 200° C. using a biaxial kneading extruder (manufactured by TOSHIBA MACHINE CO., LTD., trade name: TEM-26SX), extruded into the shape of a cylinder of 3 mm in diameter, cooled and then cut into pellets each having a diameter of 3 mm, and a length of 3 mm with a cutter to produce a resin material. A long sheet of SUS304-CSP-1/2H material of 15.2 mm in transverse direction and 0.08 mm in thickness was used for manufacturing a support member.

Figure 8:
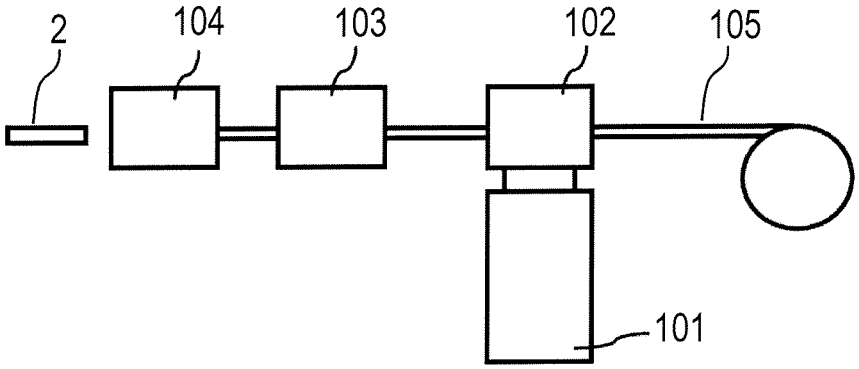
FIG. 8 is a schematic diagram illustrating an example of an apparatus for manufacturing the developer regulating member.

An apparatus for manufacturing a developer regulating member, wherein the summary was illustrated in FIG. 8 was used. The produced pellet-like resin raw material was first molten at 200° C. and injected into the molding cavity of an extrusion die 102 in an extruder 101. An end face in the transverse direction of the long sheet 105 was moved in the molding cavity of the extrusion die 102 simultaneously. A portion including the end face of the support member was covered with the molten resin material. The temperature of the die 102 was set as 250° C.

This long sheet was ejected from the extrusion die 102, and the resin material was solidified with a cooler 103. A member with the end face and the two principal surfaces (areas from the end face to a line a predetermined distance away from the end face) of the long sheet covered with the solidified resin material was obtained. This member was cut to 226 mm in length in the longitudinal direction with the cutter 104 to manufacture a developer regulating member 2 having the structure illustrated in FIG. 2.

When DSC measurement was performed in the same manner as in Example 1 on the thus obtained developer regulating member, the temperature of a peak A having a higher endothermic peak temperature was +115° C., and the temperature of a peak B having a lower endothermic peak temperature was −56° C. When the contents of the components were measured with the nuclear magnetic resonance apparatus in the same manner as in Example 1, the component of peak A was a methyl methacrylate polymer, its content was 51% by mass, the component of peak B was an n-butyl acrylate polymer, and its content was 49% by mass. When the regulating portion was observed through a transmission electron microscope (TEM) using phosphotungstic acid as a dyeing agent, it was further confirmed that the regulating portion had a micro phase separation structure as illustrated in FIG. 1.

Measurement 1 to Measurement 3 and Evaluation 1 to Evaluation 3 described in Example 1 were performed on the developer regulating member according to the present Example.

Example 10

A developer regulating member was manufactured in the same manner as in Example 9 except that a thermoplastic acrylic resin block copolymer (Mw=60500, produced by KURARAY CO., LTD., trade name: KURARITY LA2270) was used as a resin Z, and the developer regulating member was subjected to Measurement 1 to Measurement 3 and Evaluation 1 to Evaluation 3 described in Example 1.

Example 14

A developer regulating member was manufactured in the same manner as in Example 10 except that electroconductive carbon black was not used, and the developer regulating member was subjected to Measurement 1 to Measurement 3 and Evaluation 1 to Evaluation 3 described in Example 1.

Example 15

A developer regulating member was manufactured in the same manner as in Example 10 except that 5 parts by mass of lithium trifluoromethanesulfonate (produced by Mitsubishi Materials Electronic Chemicals Co., Ltd., trade name: F TOP EF-15, indicated as "TfLi" in Table 2) was added as an ionic electroconductive agent, and the developer regulating member was subjected to Measurement 1 to Measurement 3 and Evaluation 1 to Evaluation 3 described in Example 1.

Example 16

A developer regulating member was manufactured in the same manner as in Example 14 except that 5 parts by mass of lithium trifluoromethanesulfonate (produced by Mitsubishi Materials Electronic Chemicals Co., Ltd., trade name: F TOP EF-15) was added as an ionic electroconductive agent, and the developer regulating member was subjected to Measurement 1 to Measurement 3 and Evaluation 1 to Evaluation 3 described in Example 1.

Tables 2 and 3 shows the test conditions and results of Examples and Comparative Examples. In each of the examples other than Comparative Examples 4 to 7, two endothermic peaks existed on the differentiation curve of the DSC curve. In each of Comparative Examples 4 to 7, only one endothermic peak existed on the differentiation curve of the DSC curve.

TABLE 3

| | | Charge of developer (μC/g) | Ratio of low triboelectric charge developer (%) | Fog (%) |
|---|---|---|---|---|
| Example | 1 | 50 | 0.6 | 0.7 |
| | 2 | 46 | 1.3 | 1.4 |
| | 3 | 45 | 1.1 | 1.7 |
| | 4 | 42 | 2.9 | 4.7 |
| | 5 | 43 | 2.3 | 2.1 |
| | 6 | 45 | 2.1 | 2.0 |
| | 7 | 43 | 2.5 | 4.4 |
| | 8 | 44 | 2.7 | 4.6 |
| | 9 | 52 | 0.4 | 0.5 |
| | 10 | 51 | 0.5 | 0.6 |
| | 11 | 41 | 2.6 | 4.3 |
| | 12 | 43 | 2.5 | 4.7 |
| | 13 | 49 | 0.7 | 0.9 |
| | 14 | 45 | 2.0 | 4.1 |
| | 15 | 53 | 0.3 | 0.5 |
| | 16 | 50 | 0.8 | 0.7 |
| | 17 | 37 | 2.7 | 4.3 |
| | 18 | 36 | 2.2 | 4.8 |
| | 19 | 33 | 2.8 | 4.3 |
| | 20 | 35 | 2.6 | 4.9 |
| | 21 | 38 | 2.8 | 4.4 |
| | 22 | 34 | 2.3 | 4.9 |
| Comparative Example | 1 | 28 | 9.4 | 14.9 |
| | 2 | 30 | 8.2 | 13.5 |
| | 3 | 31 | 10.1 | 15.7 |
| | 4 | 32 | 7.7 | 12.8 |
| | 5 | 16 | 12.5 | 17.0 |

TABLE 2

| | | Peak A (° C.) | Peak B (° C.) | Content of component of peak A (% by mass) | Content of component of peak B (% by mass) | Electroconductive particle | Ionic electroconductive agent |
|---|---|---|---|---|---|---|---|
| Example | 1 | +115 | −56 | 50 | 50 | CB | — |
| | 2 | +55 | −56 | 50 | 50 | CB | — |
| | 3 | +115 | +10 | 50 | 50 | CB | — |
| | 4 | +55 | +10 | 50 | 50 | CB | — |
| | 5 | +115 | −56 | 50 | 50 | CB | — |
| | 6 | +115 | −56 | 50 | 50 | CB | — |
| | 7 | +115 | −56 | 50 | 50 | CB | — |
| | 8 | +115 | −56 | 50 | 50 | CB | — |
| | 9 | +115 | −56 | 51 | 49 | CB | — |
| | 10 | +115 | −56 | 38 | 62 | CB | — |
| | 11 | +115 | −56 | 20 | 80 | CB | — |
| | 12 | +115 | −56 | 79 | 20 | CB | — |
| | 13 | +115 | −70 | 50 | 50 | CB | — |
| | 14 | +115 | −56 | 38 | 62 | — | — |
| | 15 | +115 | −56 | 38 | 62 | CB | TfLi |
| | 16 | +115 | −56 | 38 | 62 | — | TfLi |
| | 17 | +115 | −56 | 50 | 50 | CB | — |
| | 18 | +115 | −56 | 50 | 50 | CB | — |
| | 19 | +115 | −56 | 50 | 50 | CB | — |
| | 20 | +115 | −56 | 50 | 50 | CB | — |
| | 21 | +115 | −56 | 18 | 82 | CB | — |
| | 22 | +115 | −56 | 82 | 18 | CB | — |
| Comparative Example | 1 | +18 | −56 | 50 | 50 | CB | — |
| | 2 | +115 | +55 | 50 | 50 | CB | — |
| | 3 | +18 | +10 | 50 | 50 | CB | — |
| | 4 | +115 | — | 100 | — | CB | — |
| | 5 | −56 | — | 100 | — | CB | — |
| | 6 | +55 | — | 100 | — | CB | — |
| | 7 | +18 | — | 100 | — | CB | — |

TABLE 3-continued

| | Charge of developer (μC/g) | Ratio of low triboelectric charge developer (%) | Fog (%) |
|---|---|---|---|
| 6 | 33 | 6.4 | 11.6 |
| 7 | 18 | 13.0 | 17.4 |

Each of the developer regulating members of Examples is a developer regulating member using thermoplastic acrylic resins having endothermic peaks having peak tops at +50° C. or more and +20° C. or less on a DSC differentiation curve, respectively. In Examples, it was found that enough charge could be given to the developer, and that the shortage of the charge of the developers was suppressed. Good results were consequently obtained in the evaluation of fog.

On the other hand, since Comparative Examples 1 to 7 do not exhibit at least one of an endothermic peak having a peak top at +50° C. or more and that at +20° C. or less, the ease of sliding of the developer on a developer carrier and the adhesion are not at suitable levels. Consequently, the developer merely moves while sliding on the developer regulating member, or adheres to the developer regulating member, and the developer cannot be rolled on the developer regulating member. The ratio of a low triboelectric charge developer was therefore high, and the fog was 10% or more.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-135904, filed Jul. 19, 2018, which is hereby incorporated by reference herein in its entirety.

What is claimed is:

1. A developer regulating member for regulating a thickness of a layer of a developer carried on a surface of a developer carrier, the developer regulating member comprising a regulating portion in contact with the developer, wherein the regulating portion comprises a thermoplastic acrylic resin, and wherein the thermoplastic acrylic resin has a first endothermic peak having a peak top at +50° C. or more and a second endothermic peak having a peak top at +20° C. or less on a differentiation curve of a DSC curve obtained when temperature is raised from −100° C. to 150° C. at a rate of temperature rise of 20.0° C./min using differential scanning calorimetry (DSC).

2. The developer regulating member according to claim 1, wherein the thermoplastic acrylic resin comprises a first polymer exhibiting the first endothermic peak and a second polymer exhibiting the second endothermic peak.

3. The developer regulating member according to claim 2, wherein the first polymer has a weight average molecular weight of $1\times10^4$ to $5\times10^4$.

4. The developer regulating member according to claim 2, wherein the second polymer has a weight average molecular weight of $1\times10^4$ to $1\times10^5$.

5. The developer regulating member according to claim 2, wherein a content of the first polymer is 20% by mass to less than 80% by mass based on a total amount of the thermoplastic acrylic resin.

6. The developer regulating member according to claim 2, wherein the first polymer comprises a repeating unit derived from methyl methacrylate, and the second polymer comprises a repeating unit derived from n-butyl acrylate or 2-ethylhexyl acrylate.

7. The developer regulating member according to claim 1, wherein the thermoplastic acrylic resin is a block copolymer of a first polymer block exhibiting the first endothermic peak and a second polymer block exhibiting the second endothermic peak.

8. The developer regulating member according to claim 7, wherein a weight average molecular weight of the block copolymer is $1\times10^4$ to $9\times10^5$.

9. The developer regulating member according to claim 7, wherein a content of the first polymer block is 20% by mass to less than 80% by mass based on a total amount of the block copolymer.

10. The developer regulating member according to claim 7, wherein the first polymer block comprises a repeating unit derived from methyl methacrylate, and the second polymer block comprises a repeating unit derived from n-butyl acrylate or 2-ethylhexyl acrylate.

11. The developer regulating member according to claim 1, wherein the regulating portion comprises an electroconductive agent.

12. The developer regulating member according to claim 1, further comprising a support member supporting the regulating portion, wherein the regulating portion is disposed on or near an end of the support member.

13. The developer regulating member according to claim 12, further comprising:

a projection extending from a contact portion of the regulating portion toward a side for feeding the developer to the contact portion, the regulating portion contacting the developer on the contact portion; and a step in a thickness direction of the support member formed over a region from the contact portion to the projection, wherein the support member extends to a position of the projection.

14. A developing device, comprising:

a developer carrier;

a developer regulating member disposed in contact with a surface of the developer carrier; and a developer container storing a developer, wherein the developer regulating member comprises a thermoplastic acrylic resin, and wherein the thermoplastic acrylic resin has a first endothermic peak having a peak top at +50° C. or more and a second endothermic peak having a peak top at +20° C. or less on a differentiation curve of a DSC curve obtained when temperature is raised from −100° C. to 150° C. at a rate of temperature rise of 20.0° C./min using differential scanning calorimetry (DSC).

15. A process cartridge detachably attachable to a body of an electrophotographic image forming apparatus, the process cartridge comprising:

a developer carrier;

a developer regulating member disposed in contact with a surface of the developer carrier; and a developer container storing a developer, wherein the developer regulating member comprises a thermoplastic acrylic resin, and wherein the thermoplastic acrylic resin has a first endothermic peak having a peak top at +50° C. or more and a second endothermic peak having a peak top at +20° C. or less on a differentiation curve of a DSC curve obtained when temperature is raised from −100° C. to 150° C. at a rate of temperature rise of 20.0° C./min using differential scanning calorimetry (DSC).

* * * * *